US007252107B2

(12) United States Patent
Chu et al.

(10) Patent No.: US 7,252,107 B2
(45) Date of Patent: Aug. 7, 2007

(54) POP UP COLLAPSIBLE STRUCTURES

(75) Inventors: Wan-sing Chu, Hong Kong (CN); Lai-Ha Wu, Hong Kong (CN)

(73) Assignee: Best Tide Mfg. Co., Ltd., Hong Kong (CN)

( * ) Notice: Subject to any disclaimer, the term of this patent is extended or adjusted under 35 U.S.C. 154(b) by 0 days.

(21) Appl. No.: 11/283,364

(22) Filed: Nov. 18, 2005

(65) Prior Publication Data

US 2006/0070648 A1 Apr. 6, 2006

Related U.S. Application Data

(62) Division of application No. 10/404,933, filed on Apr. 1, 2003, now abandoned.

(30) Foreign Application Priority Data

Mar. 27, 2003 (HK) ..... 03102223.2

(51) Int. Cl.
*E04H 15/40* (2006.01)

(52) U.S. Cl. ..... 135/126; 135/128; 135/147; 446/487

(58) Field of Classification Search ..... 135/125–126, 135/128, 96–97, 117, 147, 151–152; 446/487, 446/478; D21/836, 510; 220/9.2–9.3
See application file for complete search history.

(56) References Cited

U.S. PATENT DOCUMENTS 3,105,505 A 10/1963 Maybee
3,625,235 A 12/1971 Gorgichuk
3,987,580 A 10/1976 Ausnit
4,073,105 A 2/1978 Daugherty
4,825,892 A 5/1989 Norman
5,038,812 A 8/1991 Lowell
5,137,044 A 8/1992 Brady
5,238,015 A 8/1993 Gretzmacher et al.
5,301,705 A 4/1994 Zheng
5,394,897 A * 3/1995 Ritchey et al. ..... 135/124
5,411,046 A 5/1995 Wan
5,467,794 A 11/1995 Zheng
5,560,385 A 10/1996 Zheng
5,579,799 A 12/1996 Zheng
5,618,246 A * 4/1997 Zheng ..... 482/35

(Continued)

FOREIGN PATENT DOCUMENTS

EP 0 928 864 7/1999

(Continued)

*Primary Examiner*—Winnie Yip
(74) *Attorney, Agent, or Firm*—Ladas and Parry LLP

(57) ABSTRACT

A foldable enclosure structure containing a fabric cover defining a desired shape when expanded to an expanded position; a first supporting frame fixedly attached to the cover and a second supporting frame provided within the cover and rotatably coupled to the first frame such that the second frame is movable between a collapsed position and an expanded position. The second frame is superposed over the first frame in the collapsed position for ease of storage, but is rotated axially to intersect with the first frame in the expanded position to prop up the cover to the desired shape. To ensure that the structure is stable in the expanded position, fixing means is/are provided for fixedly attaching the second frame to the first frame in the expanded position.

18 Claims, 5 Drawing Sheets

U.S. PATENT DOCUMENTS

| | | | | |
|---|---|---|---|---|
| 5,664,596 | A | | 9/1997 | Zheng |
| 5,778,915 | A | | 7/1998 | Zheng |
| 5,816,279 | A | | 10/1998 | Zheng |
| 5,943,709 | A | * | 8/1999 | Chiu ..... 4/506 |
| 6,092,544 | A | | 7/2000 | Zheng |
| 6,138,701 | A | | 10/2000 | Zheng |
| 6,155,261 | A | | 12/2000 | Zheng |
| 6,209,557 | B1 | | 4/2001 | Zheng |
| 6,220,265 | B1 | | 4/2001 | Zheng |
| 6,257,263 | B1 | | 7/2001 | Brereton |
| 6,109,281 | A1 | | 8/2001 | Lowenthal |
| 6,269,826 | B1 | | 8/2001 | Zheng |
| 6,284,330 | B1 | | 9/2001 | Hermanson |
| 6,305,396 | B1 | | 10/2001 | Zheng |
| 6,311,709 | B1 | | 11/2001 | Louie et al. |
| 6,328,050 | B1 | | 12/2001 | McConnell |
| 6,357,462 | B1 | | 3/2002 | Darani et al. |
| 6,357,510 | B1 | | 3/2002 | Zheng |
| 6,360,761 | B1 | | 3/2002 | Zheng |
| 6,363,955 | B1 | | 4/2002 | Loule |
| 6,390,111 | B2 | | 5/2002 | Zheng |
| 6,499,498 | B1 | | 12/2002 | Zheng |
| 6,604,537 | B2 | | 8/2003 | Zheng |
| D482,797 | S | * | 11/2003 | Chiu ..... D25/1 |
| D493,506 | S | * | 7/2004 | Birchenough ..... D21/836 |
| 6,827,094 | B1 | | 12/2004 | Bramwells |
| 6,854,476 | B1 | * | 2/2005 | Chai ..... 135/135 |
| 2001/0011550 | A1 | | 8/2001 | Zheng |
| 2002/0078989 | A1 | | 6/2002 | Zheng |
| 2002/0088564 | A1 | | 7/2002 | Zheng |
| 2002/0096205 | A1 | | 7/2002 | Zheng |
| 2003/0070703 | A1 | | 4/2003 | Zheng |
| 2004/0168715 | A1 | | 9/2004 | Wang |

FOREIGN PATENT DOCUMENTS

| | | | |
|---|---|---|---|
| EP | 1 043 049 | | 10/2000 |
| EP | 1 054 121 | | 11/2000 |
| EP | 1055438 | * | 11/2000 |
| EP | 1 061 206 | | 12/2000 |
| EP | 1 094 177 | | 4/2001 |
| EP | 1143 087 | | 10/2001 |
| GB | 2 061 351 | | 5/1981 |
| WO | 01/40603 | | 6/2001 |

* cited by examiner

POP UP COLLAPSIBLE STRUCTURES

This is a divisional of copending application Ser. No. 10/404,933 filed on Apr. 1, 2003 now abandoned, claims the benefit thereof and incorporates the same by reference.

FIELD OF INVENTION

The present invention is related to collapsible toy structures such as tents and playhouses.

BACKGROUND OF INVENTION

Collapsible structures that are used for playhouses are well-known in the art. They are typically collapsible into a small volume but can be easily popped up by various means, including the use of extendable frames and inflatable tubes. U.S. Pat. No. 6,305,396 described a collapsible structure that is provided with a plurality of foldable frame members each having a folded and an unfolded orientation. A fabric material is provided for covering a portion of each frame member to form a side panel therefrom. The structure may be folded and stored by folding the side panels and their corresponding frame members on top of each other about the hinge portions to have the side panels and frame members overlying each other. The overlying side panels and frame members are then collapsed by twisting and folding to form a plurality of concentric frame members to substantially reduce the size of the structure.

The above described structure has many advantages, but has the limitation of not being able to create structures with irregular sides or unusual shapes. One solution to this problem is provided by the Airmaze air play tent that uses a fan to blow the enclosure open. The fan, however, obviously poses a hazard, especially to small children. It is therefore an object to have present invention to provide improved collapsible structures.

SUMMARY OF INVENTION

Accordingly, the present invention provides a foldable enclosure structure containing a fabric cover defining a desired shape when expanded to an expanded position; a first supporting frame attached to the cover; and a second supporting frame provided within the cover and rotatably coupled to the first frame such that the second frame is movable between a collapsed position and an expanded position. According to the structure of the instant invention, the second frame is superposed over the first frame in the collapsed position for ease of storage, but is rotated axially to intersect with the first frame in the expanded position to prop up the cover to the desired shape. To ensure that the structure is stable in the expanded position, fixing means are provided for fixedly attaching the second frame to the first frame in the expanded position.

In the preferred embodiment, the shape of the two frames assume the same shape as the cross-sectional shape of the cover along the points to which they attach such that they effectively prop up the cover in the expanded position.

In another embodiment, the first and second frames are both fixedly sewn onto the cover. The frames may be sewn either onto the inner or outer sides of the cover. The intersections between the first and second frames are left unsewn, such that the two frames can rotate axially relative to each other.

In another preferred embodiment, the first and second frames are each foldable from an open position to a folded position, the folded position achievable by twisting and folding the frames into at least two concentric circles. Since the two frames are superimposed onto each other in the collapsed position, it is most convenient for the user to twist and fold the two frames together simultaneously. This would reduce the total area of the collapsed structure to a minimum.

In one specific embodiment of a toy house, the first and second frames are each in the general shape of a loop and containing a first and second central vertical axis respectively. The first and second frames are coupled together such that the first and second central vertical axes coincide with each other, and the second frame rotatable therealong. In this embodiment, the two loops may be coupled theretogether by an elastic band provided at the top intersection between the frames. In another preferred embodiment, the fixing means is a set of Velcro tapes that allow the two frames to be fixedly attached theretogether after the second frame has been rotated to the expanded position.

In another embodiment, the fixing means is a bottom pad for mounting onto the bottom of the enclosure. This bottom pad has a bottom frame shaped to match the shape of the bottom of the desired shape for abutment of the first and second frame in the expanded position.

Near the top of the structure, at least one reinforcement frame may further be attachable along the girth of the first and second frames in the expanded position to prop up the cover to the desired shape. This reinforcement frame is preferably attached to the first and second frames after they are arranged into the expanded position.

In another preferred embodiment, the cover defines a complete enclosure with a top portion, a bottom portion and side portions for sheltering at least one person therein, the cover further provided with at least one opening for the person to access therethrough.

In another embodiment, the first and second frames are each in the general shape of a loop with a first and second central horizontal axis respectively. The first and second frames are coupled together such that the first and second central horizontal axes coincide with each other, and the second frame rotatable therealong. This embodiment is suitable for shapes such as aeroplanes and airships. In the preferred embodiment, the fixing means is at least one loop attachable to the first and second frames along the vertical girth for abutment in the expanded position.

In another aspect of the present invention, a method of supporting a fabric enclosure is provided comprising providing a plurality of rigid or semi-rigid loops having a shape of a section of the enclosure and defining a central axis therein; fixedly attaching one of the loop to a cross-section of the enclosure; and coupling the other loop or loops to the attached loop at a position wherein the loop or loops are rotatable along the central axis relative to the attached loop. In the preferred method, the loops in pre-determined relative position are abutted into position using a reinforcement frame.

Using the teaching provided herein, many different structures with various shapes may be made. The structures may be expanded to huge enclosures, but readily collapsible into a very small package of concentric circles for ease of handling and storage. The time and skills required to construct the structure is nominal, since it is capable of expanding upon release, and the loops are coupled together such that they only need to be rotated into the appropriate expanded position, and the fixing means attached.

DETAILED DESCRIPTION

In the following description and in the claims, the term "fabric" is simply used to describe a material that has the collapsible and foldable characteristics of a fabric, and is not meant to limit the instant invention to any particular type of material. The cover may be made of, among other things, nylon, cotton, leather, PVC and other natural, synthetic or blended material. The term "loop" is defined loosely as any rigid or semi-rigid frame that forms a complete piece without any break in the frame. The "loop" may be of any shape, such as circular, triangular, quadrilateral, polylateral, mushroom, or any other regular or irregular shape. A "semi-rigid" frame has the characteristic of maintaining a defined shape when it is expanded into the fully open position, but can also be folded, or twisted into concentric circles, or otherwise collapsible by other ways.

Figure 1B:
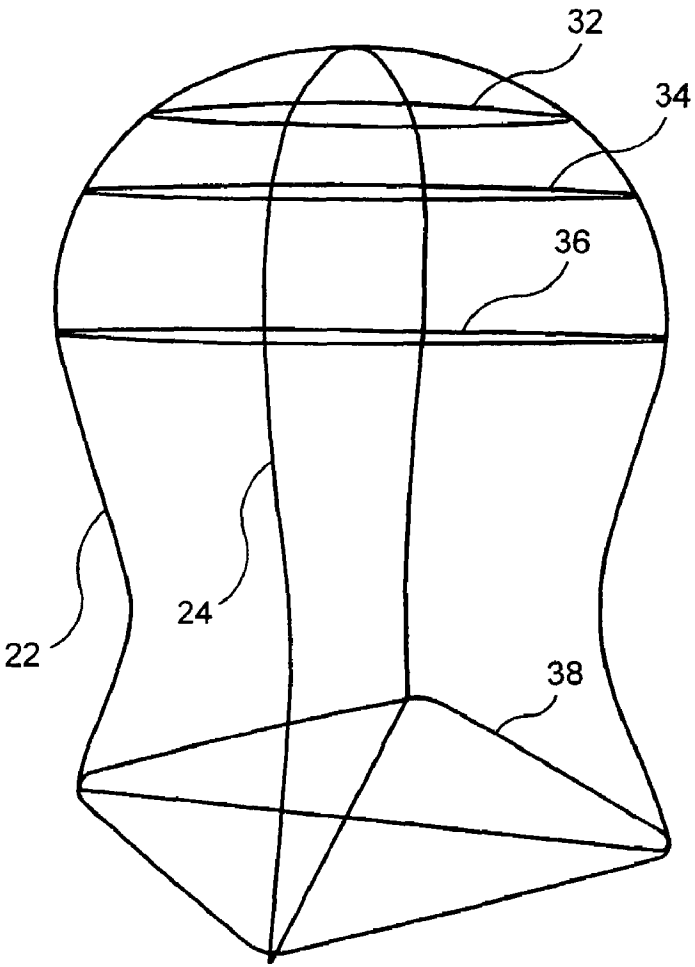
FIG. 1B shows the assembled supporting structures according to the same embodiment as FIG. 1A. The fabric cover is not shown.
Figure 1A:
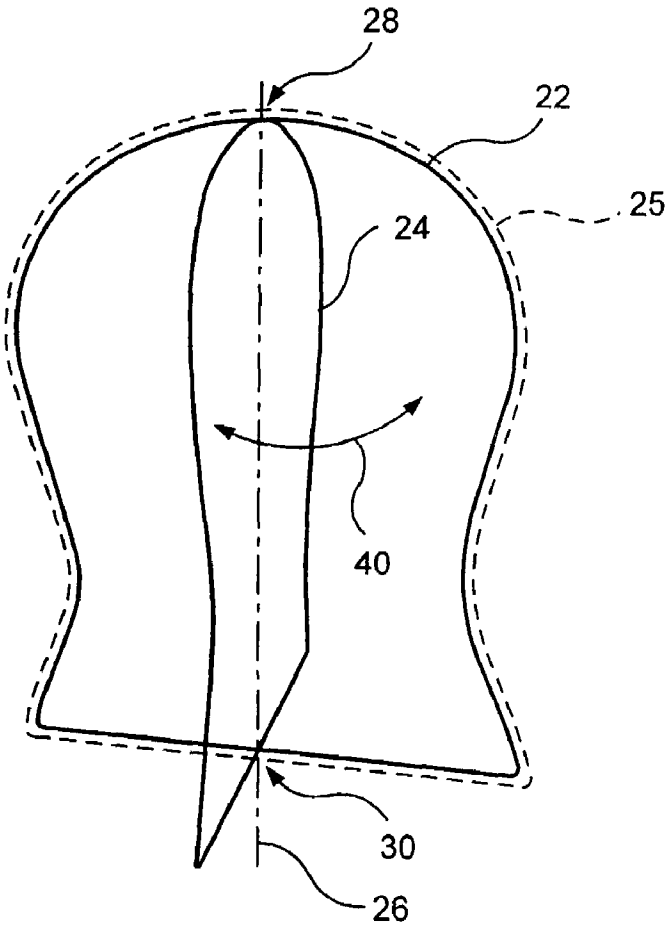
FIG. 1A is a drawing of an exploded view of the supporting structures according to one embodiment of the present invention. The fabric cover is not shown for ease of understanding.
Figure 1C:
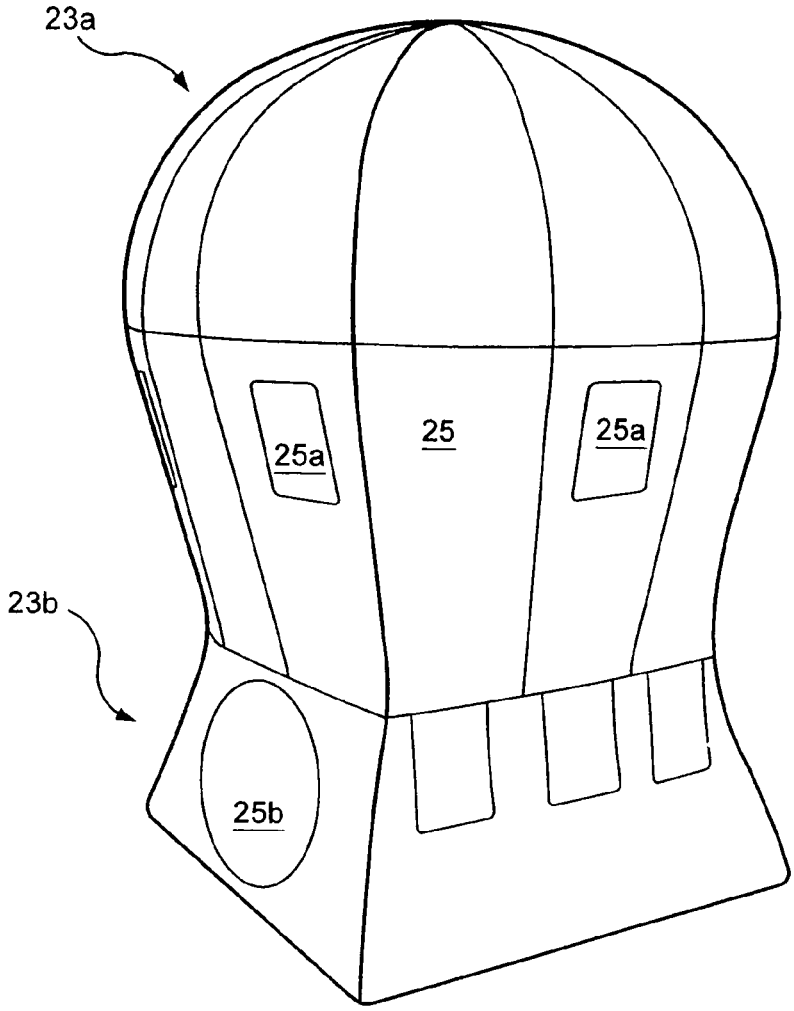
FIG. 1C shows the perspective view of the fully expanded cover of the enclosure structure according to the same embodiment as FIG. 1A with windows and openings that can be provided on the cover.

Referring to FIGS. 1A to 1C, the first embodiment exemplifying the present invention shows two identical frames 22 and 24 that have a mushroom-like shape in the fully open position. A fabric enclosure assuming the shape of a mushroom with a dome-shaped top 23*a* and a short, thick stem at the bottom 23*b* (see FIG. 1C). The bottom portion of the stem is also shown to have a girth that spreads wider than the top portion of the stem. For ease of illustration, only FIG. 1C shows the fabric enclosure or cover, and the relative position of the same cover is only shown as dotted lines in FIG. 1A. The two frames in the open position assumes a shape that is the same as the cross-sectional shape of the cover (i.e. a mushroom shape in this example) along which they should propping up in the expanded position. In the most preferred embodiment, the first frame 22 is sewn and fixed onto the appropriate position along the cover. The first frame is sewn on the inside of the cover. In the operating position, the two frames are provided in the upright position, each with a central vertical axis defined therein (in FIG. 1A, the two frames are positioned such that their central axes coincide along line 26). In this embodiment, the second frame is also be fixedly sewn onto the inside of the cover, except that the points of intersection 28 and 30 with the first frame are not sewn to the cover, such that the two frames may rotate axially relative to each other as shown by arrow 40. In this embodiment, first and second frames may be sewn either on the outside or the inside of the cover, and are considered "rotatably coupled" with the cover itself acting as the coupling means.

In this example, the frames are arranged such that they are axially aligned along the vertical axis and, when the frames are in the expanded position, intersect at a 90 degree angle. In this embodiment, three optional reinforcement loops 32, 34 and 36 of varying sizes, and a square pad 38 with a semi-rigid frame is also provided. Pad 38 assumes the same shape as defined by the bottom of the two frames, and once it is inserted into the enclosure as shown in FIG. 1B, the two frames would be secured at a 90 degree angle. The three reinforcement loops can then be attached along various heights of the girth of the top portion of the mushroom structure, for example by velcro tapes provided at the appropriate position. The cover 25 as shown in FIG. 1C also illustrates how windows 25*a* and openings 25*b* may be provided.

Figure 1D:
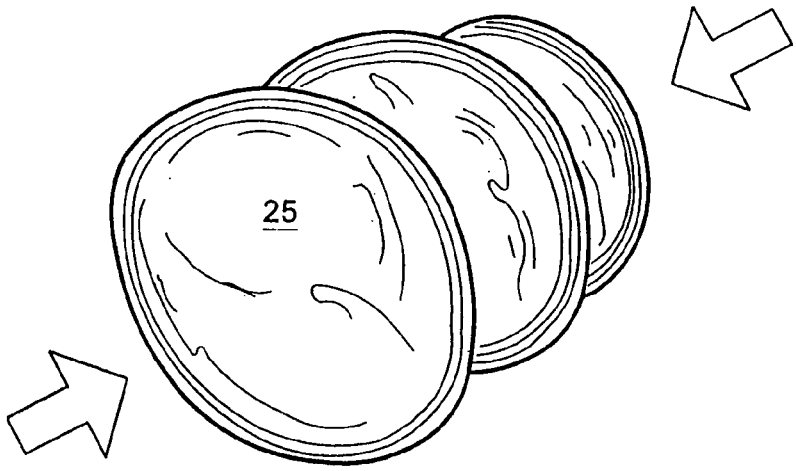
FIG. 1D shows the step of the folding process for a frame into three concentric loops.

When a user wants to store the mushroom in a small package, the semi-rigid detachable reinforcement loops 32, 34 and 36 and the pad 38 are removed. Frame 24 is then rotated according to general direction shown by arrow 40 such that frame 22 and 24 are superimposed one next to another. Due to the soft, foldable nature of the cover, the frames are readily rotatable and foldable even if they are fixedly sewn onto the cover. They can then be twisted into three concentric circles, and the fabric of the cover, still attached to frame 22, would collapse together with the frames. The three reinforcement loops and the pad can also be twisted and folded into smaller concentric loops for ease of storage. The way one of the loops may be folded is shown in FIG. 1D. Although only one loop is shown in FIG. 1D, it is understandable that all the semi-rigid loops can be folded up in the same manner as illustrated in FIG. 1D.

Figure 2B:
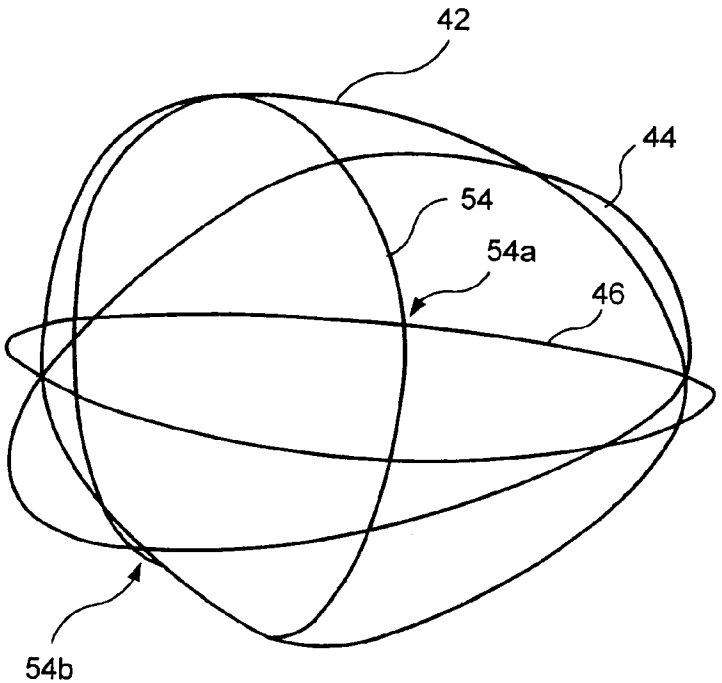
FIG. 2B shows an additional reinforcement loop provided within the structure shown in FIG. 2A.
Figure 2A:
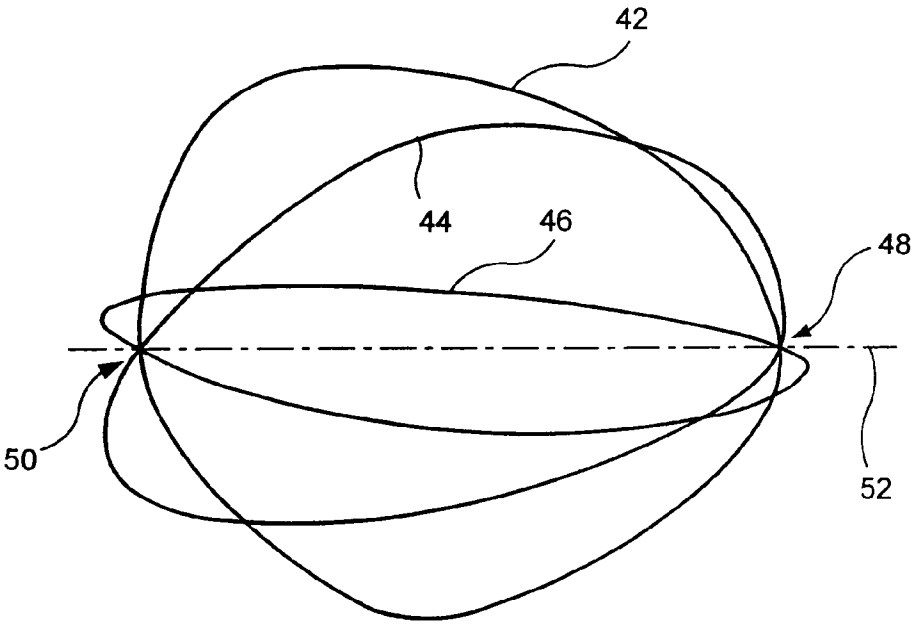
FIG. 2A shows a second embodiment according to the present invention in which a first, second and third frames are rotatable along a horizontal axis in an expanded position.
Figure 2D:
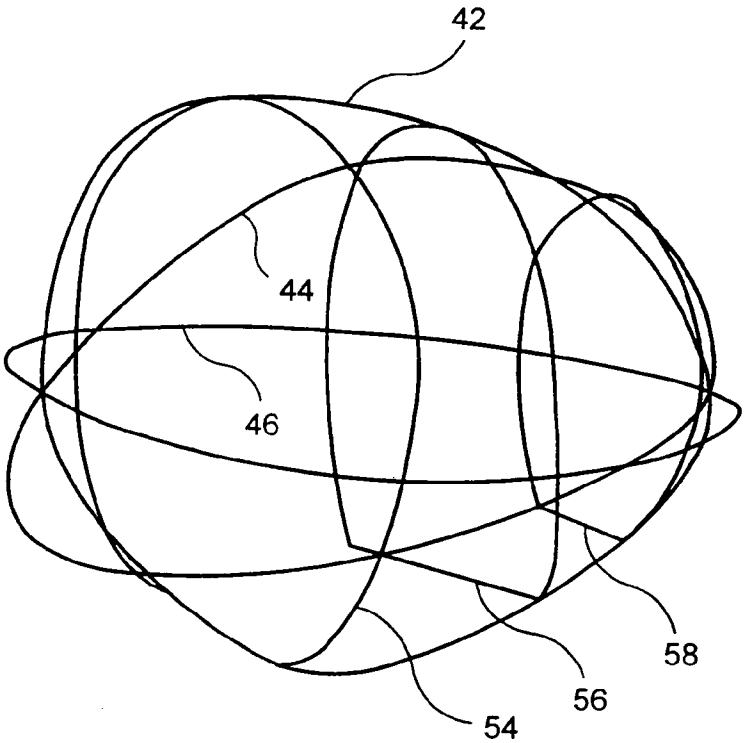
FIGS. 2C and 2D shows a second and third reinforcement loop provided respectively within the structure shown in FIG. 2B.
Figure 2C:
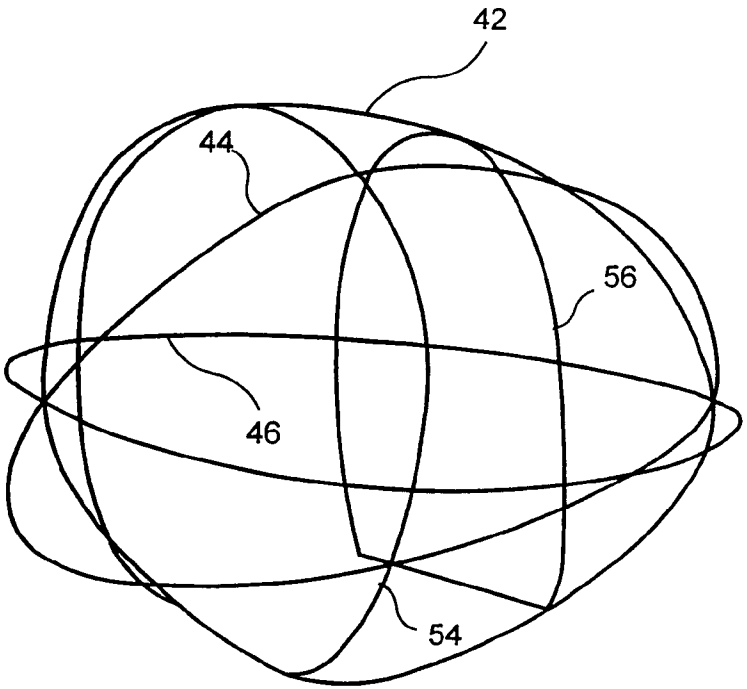

Referring now to FIG. 2A to 2C, another embodiment of the present invention is shown in the form of a generally olive-shaped space ship. In this example, there are three identical frames 42, 44 and 46 provided within a fabric cover or enclosure that has a general olive shape lying on its side under normal usage. For ease of illustration, the fabric cover is not shown in order to review the supporting structures therein. It is understood that openings may be provided in the enclosure for a user such as a child to enter the space ship and reside within the confines of the frames. Frame 42 is fixedly sewn onto the inner side of the cover, and frames 44 and 46 are rotatably coupled thereto using an elastic band attached to the cover at the two side ends 48 and 50 of the spaceship such that frames 44 and 46 are rotatable along a horizontal axis 52 that also coincides with their respective longitudinal axis of symmetry. In the expanded position as shown, the three frames intersect each other at an angle of 60 degrees.

FIG. 2B shows one large reinforcement loop 54 provided at one end of the olive-shaped structure and aligned perpendicularly to the axis 52. For ease of description, this vertical alignment of the reinforcement loop relative to the horizontal axis of rotation is referred to as attachment of the reinforcement loop to the vertical girth of the frames. Fixing means such as Velcro tapes are provided at the relevant position of the inner side of the enclosure for the secure position thereof. In the specific example, the reinforcement loop 54 assumes a curved shape 54*a* along ¾ of sides, but contains on flat side 54*b* which is preferably facing the floor to stabilize the entire spaceship structure.

FIGS. 2C and 2D shows two further reinforcement loops 56 and 58 provided at the mid-section and right-end section of the space ship. Again, Velcro tapes are provided along the designated positions of the inner side of the cover for fixed attachment thereto. Again, the bottom side of these two reinforcement loops are flat to provide stability to the whole structure.

When a user wishes to store the spaceship in a small package, the three reinforcement loops may again be detached and the three frames 42, 44 and 46 be rotated to superimpose on each other in the collapsed form. If the three frames are large, and made of a semi-rigid material, they can be further twisted and folded simultaneously each into two or three concentric circles for storage. The three frames will stay within the fabric of the cover, and they are attached or coupled to the inner side thereof, and therefore the entire structure would conveniently be stored. The three reinforcement frames may also be twisted and folded and put in the same small bag for storage.

Figure 3:
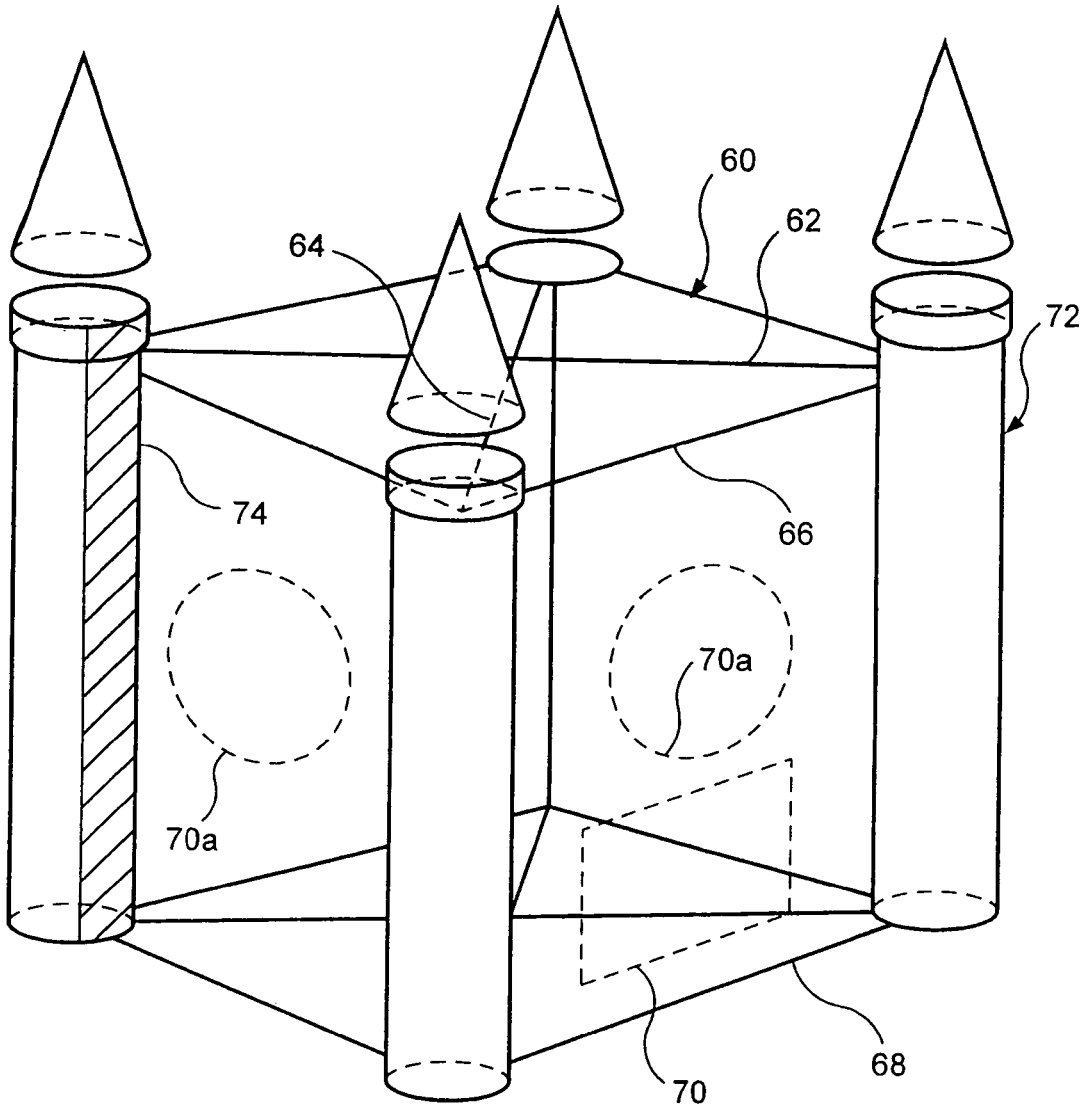
FIG. 3 shows a third embodiment of the present invention in which additional structures are provided.

FIG. 3 shows another embodiment in which the basic enclosure or cover is a cube 60, supported by two square frames 62 and 64. One optional square reinforcement frames 66 and one optional abutment frame 68 are also provided at the top and bottom respectively of the enclosure, and fixed thereto by fixing means such as Velcro tapes. An opening 70 is provided on the cover for a user to access the interior. Windows 70*a* are also provided. In this example, four additional conical/cylindrical structures 72 are provided at the four corners to give the structure the appearance of a castle. The structures 72 are simply attached onto the expanded cover using velcro tape as illustrated in the shaped area 74. For ease of illustration, only one of the four areas is shaped so as not to obscure the other structures.

Although the above example has been described generally with two or three identically shaped frames or loops, the present invention may clearly be practised with more than two loops. For example, this may be a substitution for the reinforcement frames in the larger enclosures. In such a case, the loops may be, for example, spread evenly at 60 degree angles into three evenly distributed frames. The bottom pad, if desired, may be a hexagon.

While the present invention has been described with particular reference to the aforementioned figures, it is understood that the figures are for illustration only, and the instant invention is not limited thereto. It is intended that the scope of the present invention be defined by the claims appended herewith, and include many variations and embodiments not specifically described herein. For example, the intersection of the frames in the examples are described as having 60 or 90 degree angles, but it is clear that, depending on the shape and size of the enclosure, the absence or presence of the optional reinforcement frames and other abutment means etc would affect the number and arrangement of the frames used for the fully expanded position. Furthermore, one of the fixing means are described as bottom pad or velcro tapes, but it is clear that other fixing means, such as zippers, tying cloth or string, button etc may also be used. The coupling means as described in the first example actually uses the cover therefor, with the two frames fixed thereto except at the points of intersection, while elastic band is described as the coupling means in the second example. Many other alternative arrangements may be used. For example, strings and mechanical joints may also be used.

What is claimed is:

1. A foldable enclosure structure comprising:

a first supporting frame including a first attachment point and a second attachment point;

a second supporting frame pivotable between a collapsed position and an expanded position about an axis that extends through the first and second attachment points of the first supporting frame for generally vertical orientation;

a fabric cover supported by the first and second supporting frames and defining an enclosure in the expanded position of the second supporting frame;

at least one cylindrical structure attached to at least one side of at least one of the supporting frames, the at least one cylindrical structure having a longitudinal axis that is substantially parallel to the axis of the second supporting frame; and at least one reinforcement frame positioned along a girth of the first supporting frame and the second supporting frames in the expanded position for generally horizontal orientation.

2. The foldable enclosure structure of claim 1 wherein the at least one cylindrical structure is four cylindrical structures respectively attached to four sides of the supporting frames.

3. The foldable enclosure structure of claim 1 wherein each of the first and second supporting frames has a folded orientation and an unfolded orientation and is twisted and folded to form concentric rings in the folded orientation.

4. The foldable enclosure structure of claim 1 wherein the reinforcement frame is fixed to the first and second supporting frames by a releasable fixing mechanism.

5. The foldable enclosure structure of claim 4 wherein the releasable fixing mechanism comprises Velcro tapes.

6. The foldable enclosure structure of claim 1 wherein the reinforcement frame is semi-rigid and is positioned at the inner sides of the first and second supporting frames in the expanded position.

7. The foldable enclosure structure of claim 1 further comprising an abutment frame provided horizontally at the bottom of the first and second supporting frames in the expanded position and vertical orientation of the axis.

8. The foldable enclosure structure of claim 7 wherein the abutment frame is fixed to the first and second supporting frames by a releasable fixing mechanism.

9. The foldable enclosure structure of claim 8 wherein the releasable fixing mechanism comprises Velcro tapes.

10. The foldable enclosure structure of claim 1 further comprising a conical structure provided on top of the at least one cylindrical structure.

11. The foldable enclosure structure of claim 1 wherein the first and second supporting frames each have a generally rectangular shape, and the enclosure defined by the fabric cover has a cubic shape in the expanded position.

12. The foldable enclosure structure of claim 1 wherein the at least one cylindrical structure is attached to the at least one side of the supporting frames by releasable fixing mechanism.

13. The foldable enclosure structure of claim 12 wherein the releasable fixing mechanism comprises Velcro tapes.

14. The foldable enclosure structure of claim 1 wherein at least one of the first and second supporting frames comprises a closed-loop configuration.

15. The foldable enclosure structure of claim 1 further comprising a coupling mechanism that couples the first supporting frame to the second supporting frame.

16. The foldable enclosure structure of claim 1 further comprising at least one opening on the fabric cover.

17. A foldable enclosure structure comprising:

a first supporting frame including a first attachment point and a second attachment point;

a second supporting frame pivotable between a collapsed position and an expanded position about an axis that extends through the first and second attachment points of the first supporting frame for generally vertical orientation;

a fabric cover being supported by the first and second supporting frames for defining an enclosure in the expanded position and generally vertical orientation;

four cylindrical structures respectively attached to four sides of the supporting frames that are generally vertical in the generally vertical orientation; and at least one reinforcement frame along a girth of the first supporting frame and the second supporting in the expanded position and generally vertical orientation for generally horizontal orientation, wherein each of the first and second supporting frames has a folded orientation and an unfolded orientation that is twisted and folded to form concentric rings in the folded orientation wherein each of the cylindrical structures has a longitudinal axis that is substantially parallel to the axis of the second supporting.

18. The foldable enclosure structure of claim 17 further comprising an abutment frame horizontally at the bottom of the first and second supporting frames in the expanded position and generally vertical orientation.

* * * * *